US006427287B1

(12) United States Patent
Brueckner et al.

(10) Patent No.: US 6,427,287 B1
(45) Date of Patent: Aug. 6, 2002

(54) DOOR STOP WHICH IS INTEGRATED WITH A DOOR HINGE

(75) Inventors: Lothar Brueckner, Leonberg; Dietmar Franke, Remscheid; Uwe Kirsten, Witten; Nils Magnus, Remscheid, all of (DE)

(73) Assignee: Ed. Scharwaechter GmbH, Remscheid (DE)

( * ) Notice: Subject to any disclaimer, the term of this patent is extended or adjusted under 35 U.S.C. 154(b) by 0 days.

(21) Appl. No.: 09/647,904

(22) PCT Filed: Jan. 28, 1999

(86) PCT No.: PCT/DE99/00252

§ 371 (c)(1),
(2), (4) Date: Feb. 1, 2001

(87) PCT Pub. No.: WO99/53165

PCT Pub. Date: Oct. 21, 1999

(30) Foreign Application Priority Data

Apr. 9, 1998 (DE) ..... 198 15 936
May 9, 1998 (DE) ..... 198 20 899

(51) Int. Cl.[7] ..... E05C 17/64; E05D 11/08
(52) U.S. Cl. ..... 16/342; 16/374
(58) Field of Search ..... 16/342, 339, 329, 16/330, 386, 337, 376, 273, 296, 374; 296/146.11

(56) References Cited

FOREIGN PATENT DOCUMENTS

| | | |
|---|---|---|
| DE | 8621214.1 | 1/1988 |
| GB | 2198784 A | 6/1988 |

*Primary Examiner*—Chuck Y. Mah
(74) *Attorney, Agent, or Firm*—Davidson, Davidson & Kappel, LLC

(57) ABSTRACT

The invention relates to a door stop for motor vehicle doors which is integrated with a door hinge. The door hinge is constructed of two hinge halves which are each formed by a folded part made of sheet metal. The door hinge is also constructed of a hinge pin which pivotally connects both hinge halves to one another. The first hinge half having an essentially hat-shaped cross-section engages in-between both profile limbs of the other hinge half which is essentially u-shaped. The door stop comprises braking or holding means which are radially aligned in relation to the hinge pin axis and which intereact with stopping means, said stopping means being concentrically arranged in relation to the hinge pin axis. The door stop is essentially coaxial in relation to the hinge axis. In order to produce a door stop which can be integrated and which enables a standardization of the door stop construction, the invention provides that the rotating bearing of an enclosing hinge half and the stopping device are accommodated in a stopping device housing. Said housing is primarily arranged inside the engaging hinge half having a hat-shaped profile cross-section, and is fastened on this hinge half in a rotationally fixed manner.

14 Claims, 2 Drawing Sheets

DOOR STOP WHICH IS INTEGRATED WITH A DOOR HINGE

FIELD OF THE INVENTION

Background Information

Door stop structurally combined with a door hinge for motor vehicle doors, the door hinge including of two hinge halves, each formed by a folded sheet metal part, and a hinge pin pivotably connecting the two hinge halves to one another, and one hinge half, having an essentially cap-shaped cross-sectional shape, engaging between the two profile legs of the other hinge half, which is of essentially U-shaped design, and wherein the hinge pin rests at one end on the outside of one profile leg of the other hinge half by means of a head part.

Door stops structurally combined with a door hinge and oriented coaxially to the hinge axis are conventionally known mainly in connection with hinges whose hinge halves are formed from solid moldings and are almost without exception designed as door stops placed on the upperside or underside of the hinge. They also include those designs of door stops which, although they are notable for a relatively small space requirement and can also be embodied in a plurality of more or less modified designs, require for that embodiment a substantial number of individual components that have to be produced and fitted separately. Such door stops are, moreover, principally suitable for use in connection with a sheet metal hinge, but fundamentally involve an excessive production expense and, at the same time, various uncertainties regarding the sustainable maintenance of predetermined holding positions of the doors. In addition, the number of components necessary for the door stop as a whole results in an increased probability of a clash between disadvantageous tolerance pairings and hence, naturally, the increased occurrence of noise sources within the door stop attributable to disadvantageous tolerance pairings.

Motor vehicle door hinges already equipped with an integrated door stop are also previously known, the hinge comprising a first and a second hinge half and a hinge pin consisting of solid material and the two hinge halves being designed as solid moldings. Here, the hinge pin is conventionally secured, such that it cannot rotate, in the gudgeon of one hinge half and, at least over part of its lengthwise section which engages in the gudgeon of the other hinge half, is equipped with a circulatory pattern of its cross section which deviates from the purely circular shape and to which a configuration of complementary design, again of at least part of the gudgeon hole of the other hinge, is assigned. This known design of the integrated door stop is admittedly notable, irrespective of its particular individual configuration, for dispensing with additional components, but requires a very high finishing and treatment expense, especially for forming and hardening, and for coating of the mutually interacting surfaces of the braking and holding device of the stop. This is particularly the case because the surfaces to be processed and treated are disposed within the hinge half, which is designed as a solid molding, and it is therefore always necessary for the entire hinge half to be subjected to the treatment. In addition, none of the known constructions of door stops that can be integrated into a motor vehicle door hinge permit application in conjunction with an inexpensive sheet metal hinge.

In view of the particular processing expense for door stops that can be integrated into a motor vehicle door hinge, a serious disadvantage, common to all known constructions, is considered to reside in the fact that no standardization of the components of the door stop is possible.

GB-2 198 784 discloses a door hinge, especially for vehicle doors, having an elastic spring element 37 and a braking and holding device, consisting of a first hinge part 2 with U-shaped cross section, which is mounted on the bodywork, and a second hinge part 17 with a cap-shaped cross section which, engaging into the first hinge part 2, is pivotably mounted therein by means of a hinge pin 13, the braking and holding device being formed by the spring element 37 rotably mounted on the second hinge part 17 and a projection 42 projecting into its pivot region. The pivot movement of the second hinge part 17 secured on the door is limited, in the position where the door is completely open, by a stop 10 for the pivoted second hinge part 17, said stop being formed out to project inwards in the lateral leg of the U-shaped first hinge part 2 surrounding the second hinge part 17, while the projection 42 is curved forward from the base 4 of the first hinge part 2.

SUMMARY OF THE INVENTION

An object of the invention is to provide a door stop that can be integrated into a sheet metal hinge including two folded sheet metal parts and a hinge pin, which door stop is further characterized in that its components are standardized to the extent that at least one stop housing which can be produced and processed independently of the hinge can be used in a standard design for all sheet metal hinges employed.

In the door stop according the present invention, a stop housing which can be produced and processed independently of the hinge or of the two hinge halves as a molding or profile material is used, the rotational bearing of the surrounding hinge half and the stop device being accommodated in a stop housing disposed as a whole within the engaging hinge half, which half is having an essentially cap-shaped cross-sectional shape and is accommodating the stop housing in a rotationally secure manner. The use according to the invention of a stop housing which can be produced and processed independently of the other parts of the hinge makes it possible in the first place for a door stop to be integrated into a sheet metal hinge and then, additionally, also allows a very substantial standardization of the door stop to be integrated into a sheet metal hinge, especially to the extent that uniformly prefabricated stop housings can be simply inserted into sheet metal hinges of any desired design. The securing of the stop housing on the hinge half can take place in any desired manner best suited to the particular application, so that from this standpoint also an optimum standardization solution is provided.

In a preferred embodiment of a sheet metal hinge equipped with an integrated door stop, provision is made such that the braking and holding device of the door stop comprises a lengthwise section of the hinge pin having a profile cross section deviating from the purely circular shape and a lengthwise section of the stop housing having an internal peripheral wall with a complementary non-circular design and is disposed as a whole centrally between two rotational bearings of the hinge in the stop housing, so that the stop housing and the hinge pin each possess a bearing section having a cylindrical cross-sectional shape on both sides of the braking and holding device of the door stop.

A particularly advantageous embodiment for the purposes of the most extensive standardization of door stops that can be integrated into a sheet metal hinge further provides that the hinge pin, starting from its head part, has a multistep variation of its diameter over its length, a first diameter being assigned to the near-side rotational bearing of the hinge pin in the stop housing, a first diameter variation being assigned to the formation of the braking and holding mechanism, second diameter variation being assigned to the far-side rotational bearing of the hinge pin in the stop housing and, finally, a further diameter variation being assigned to the fixing of the hinge pin in the profile leg of the other, surrounding hinge half.

In connection with a hinge pin equipped in this way, for easier assembly, with a plurality of different diameter variations consecutively stepped in the direction the hinge pin is driven in, a standardized configuration of the stop housing then additionally arises from the fact that the two cylindrical bearing recesses of the stop housing are of the same diameter as each other and a compensatory bushing compensating for the difference between the overall width of the bearing recess in the stop housing and the diameter of the diameter variation of the hinge pin assigned to the far-side rotational bearing is assigned to compensate for the diameter variation of the hinge pin assigned to the far-side rotational bearing.

In a further development of the preferred embodiment which is advantageous for the quality assurance of the hinge bearing, it is also provided that a bushing designed as a collar-type bushing and made from a maintenance-free bearing material is assigned to the near-side and far-side rotational bearings of the hinge pin, the bearing bushing assigned to the far-side bearing of the hinge pin surrounding the compensatory bushing serving to compensate for the difference in the overall width of the bearing recess for the far-side rotational bearing and the assigned diameter variation of the hinge pin.

In a further advantageous individual embodiment of a door stop integrated into a sheet metal hinge, it is also possible to provide that the hinge pin is secured against rotation in the two profile legs of the engaging U-shaped hinge half by means of a peripheral knurling in each case.

Similarly, it is also possible to provide that the stop housing, formed from a lengthwise section of a hollow profile material, is secured at both ends in the two lateral regions of the cap-shaped profile of one hinge half, one end of the stop housing engaging with its full external circumference through the associated lateral region of the cap profile and being secured in the other lateral region of the cap profile via a diametrical constriction. In conjunction therewith, either to improve the possibility of securing the stop housing against rotation or to enable the stop housing to take on other functions, it is also possible to provide that the hollow profile material forming the stop housing has a non-circular outer periphery and, in particular, possesses a profile crosssectional shape having at least one longitudinal edge.

With regard to the design of the braking and holding mechanism of the door stop, a simple but effective embodiment consists in that, over the region forming the stop device, the inner peripheral surface of the stop housing and the outer peripheral surface of the lengthwise region of the hinge pin engaging through the corresponding lengthwise section of the stop housing each have only one circulatory deviation of their peripheral surface protruding relative to the cylinder shape, the largest radially protruding circulatory deviation of the cross-sectional shape of the lengthwise section of the hinge pin interacting with the abutment region of the stop housing relative to the purely circular shape lying in the region between a few thousandths and about one tenth of the general hinge pin diameter.

Preferably, in conjunction with a corresponding design of the stop housing, two mutually opposite circulatory deviations of the hinge pin are provided and the detailed design is then such that the straight line intersecting the highest points of the mutually opposite radially protruding circulatory deviations of the hinge pin forms an angle of 90° to the straight line passing through the point of fixing and the point of the hinge plate.

Depending on the intended braking and holding positions of the motor vehicle door, it is possible to provide, as far as the assignment of the braking and holding mechanism is concerned, that the straight line intersecting the highest points of the mutually opposite radially protruding circulatory deviations of the hinge pin forms an angle of 90° to the straight line passing through the point of fixing of the hinge and the point of the hinge plate.

However it is also possible to provide, in accordance with the intended arrangement, that the highest points of the two radially protruding circulatory deviations of the hinge pin are disposed at an angle relative to one another.

In a further optimization of the present invention, finally, it is possible to provide that the inner peripheral surface of the stop housing and/or of the lengthwise section of the hinge pin engaging therein is equipped either with a slip coating or with a surface hardening.

BRIEF DESCRIPTION OF THE DRAWINGS

The present invention is described in detail in the description of an example which follows, with reference to a practical example of the preferred embodiment shown in the drawing, in which.

DETAILED DESCRIPTION

Figure 2:
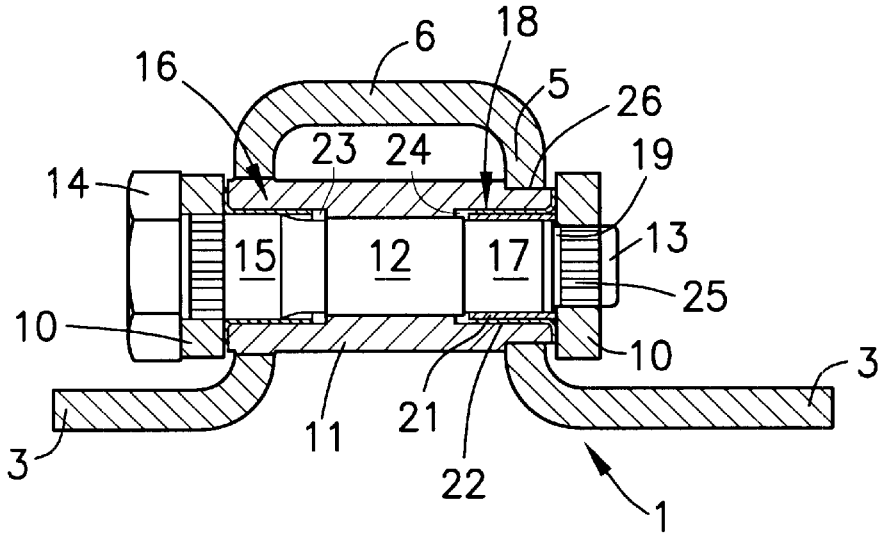
FIG. 2 shows a longitudinal section through a sheet metal hinge equipped with an integrated door stop.
Figure 1:
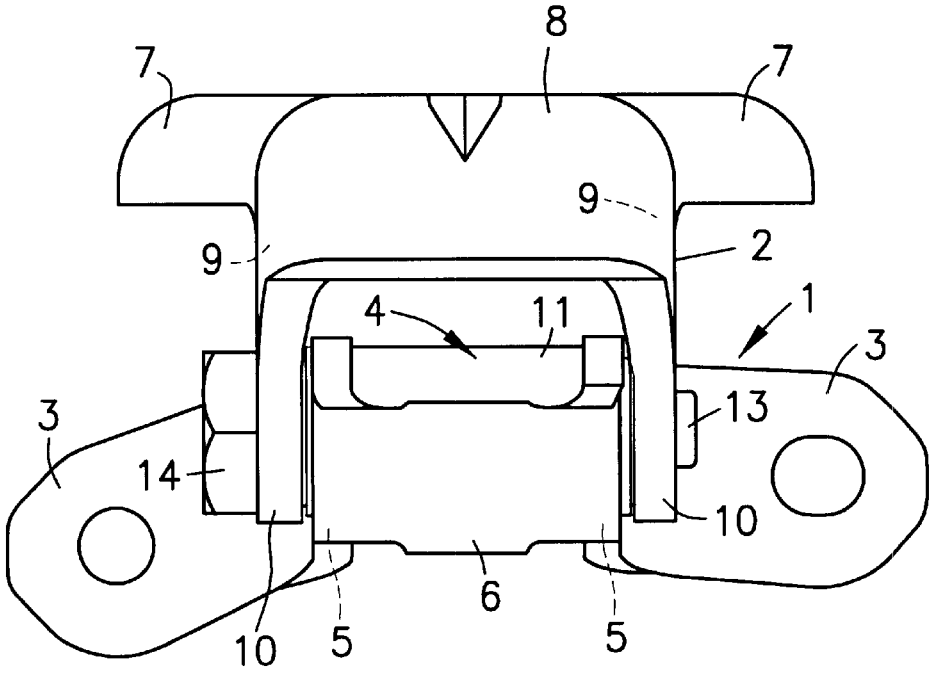
FIG. 1 shows a plan view of a sheet metal hinge equipped with an integrated door stop.
Figure 4:
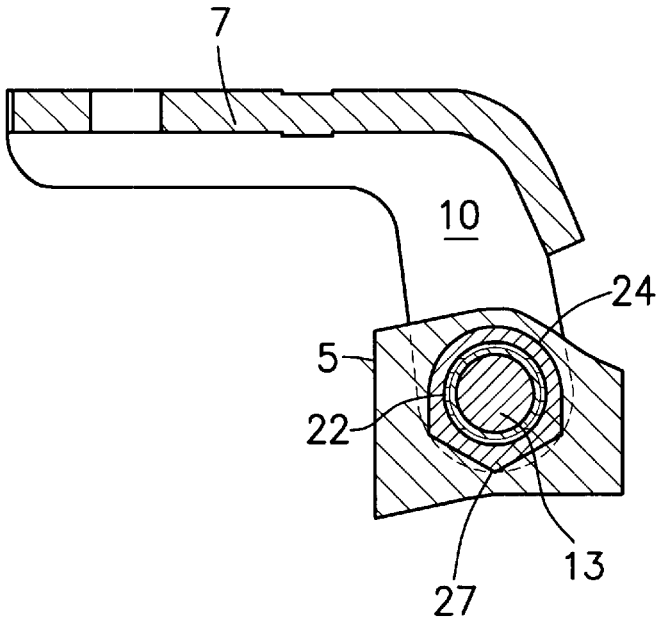
FIG. 4 shows a cross section through a sheet metal hinge according to FIGS. 1 and 2 equipped with an integrated door stop.
Figure 3:
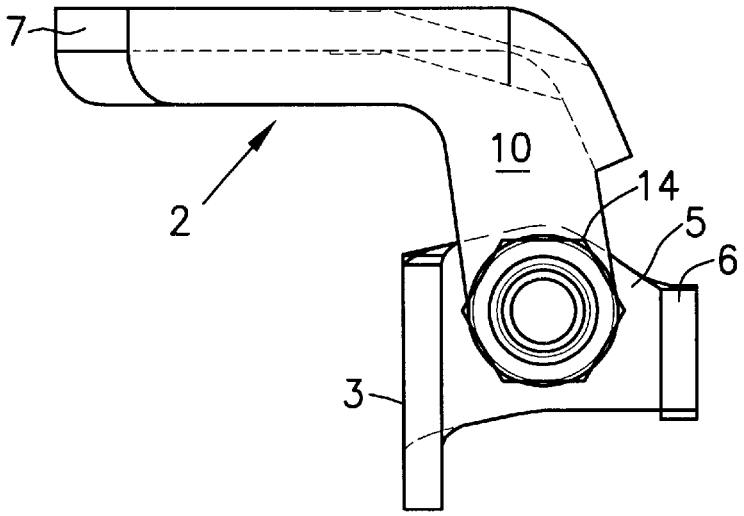
FIG. 3 shows an end view of a sheet metal hinge according to FIGS. 1 and 2 equipped with an integrated door stop.

The sheet metal hinge shown in the example of embodiment includes two hinges halves 1 and 2, each formed by a folded sheet metal part. One hinge half 1 has a cap-shaped profile cross section, the rim of the cap being formed by laterally projecting claws 3 which serve to secure the hinge half 1 on a door system part, door or door pillar, not shown in the drawing. Hinge half 1 has cap profile side areas 5 serving to secure a stop housing 4, the cap profile side areas 5 being connected to each other by a cross-piece 6. Hinge half 1 is thus designed as an engaging hinge half. The other hinge half 2, likewise formed by a folded sheet metal part, is designed as a surrounding hinge half and possesses a U-shaped profile cross section, lateral embossings 7 of the profile base 8 of the U shape forming securing claws to catch the hinge half 2 on a second door system part, again not shown in detail in the drawing. Two profile legs 9 of the U-shaped second hinge half 2 are cut free over part of their extent to form bearing arms 10. The stop housing 4 is equipped, in a central region with a braking and holding section 11, with a cross-sectional profile deviating from the purely circular shape. The braking and holding section 11 of the stop housing 4 interacts with a lengthwise section defining a braking and holding region 12 of a hinge pin 13. The braking and holding region 12 has a profile cross-section shape which differs in a complementary manner from the purely circular shape. The hinge pin 13 has a number of variations in its diameter, starting from its head part 14 in the direction the hinge pin is driven, a first diameter 15 being assigned to the near-side rotational bearing 16 of the hinge pin 13 in the stop housing 4, a first diameter variation being assigned to the formation of the braking and holding region 12, a second diameter variation 17 being assigned to the far-side rotational bearing 18 of the hinge pin 13 in the stop housing 4 and, finally, a further diameter variation 19 being assigned to the fixing of the hinge pin 13 in the profile leg 10 of the other surrounding hinge half 2. Cylindrical bearing recesses 20 and 21 are formed in the region of its two ends in the stop housing 4, each forming a rotational bearing for the hinge pin 13, and having the same diameter as each other in the interests of simplified production. A compensatory bushing 22 compensating for the difference between the overall width of the bearing recess 21 in the stop housing 4 and the diameter of the diameter variation 17 of the hinge pin 13 is assigned to compensate for the diameter variation 17 of the hinge pin 13 assigned to the far-side rotational bearing 18. In the embodiment shown, a bushing designed as a collar-type bushing 23, 24 respectively and made from a maintenance-free bearing material is assigned to the near-side 16 and far-side rotational bearings 18 of the hinge pin 13, the bearing bushing 24 assigned to the far-side bearing 18 of the hinge pin 13 engaging over the compensatory bushing 22 serving to compensate for the difference in the overall width of the bearing recess 21 for the far-side rotational bearing 18 and the assigned diameter variation 17 of the hinge pin 13. The drawing of the example of embodiment additionally shows that the hinge pin 13 is secured against rotation in the two profile legs 10 of the engaging U-shaped hinge half 2 by means of a peripheral knurling 25 in each case. Furthermore, the stop housing 4, formed from a lengthwise section of a hollow profile material, is secured at both ends in the two lateral regions 5 of the cap-shaped profile of the one hinge half 1, one end of the stop housing 4 engaging with its full external circumference through the associated lateral region 5 of the cap profile and being secured in the other lateral region 5 of the cap profile via diametrical constriction 26. The hollow profile material forming the stop housing 4 possesses, as is particularly apparent from the illustration in FIG. 3, a non-circular external circumference, such that it possesses a profile cross-sectional shape having at least one longitudinal edge 27. The inner peripheral surface of stop housing 4 may have a slip coating or hardened surface.

What is claimed is:

1. A door stop structurally combined with a door hinge for motor vehicle doors, comprising:

two hinge halves, each formed by a folded sheet metal part, a first of the two hinge halves having an essentially cap-shaped cross-sectional shape and a second of the two hinge halves being of essentially U-shaped design, a hinge pin, defining a hinge axis, having a head part and pivotably connecting said two hinge halves to one another, the hinge pin having a braking or holding region;

the second hinge half having a first leg and a second leg, said first hinge half being at least partially disposed between said first and second legs, said hinge pin being connected to the first and second legs in a manner secure against rotation and displacement, and a stop housing having a braking or holding section for interacting with the braking or holding region of the hinge pin, the stop housing being secured in said first hinge half against rotation with respect to the first hinge half, said stop housing being designed independently from the first and second hinge halves as a molding or profile material section.

2. The door stop as claimed in claim 1 wherein the braking or holding region of the hinge pin is a lengthwise section having a profile cross section deviating from a purely circular shape, and the braking or holding section of the stop housing is a lengthwise section having an internal peripheral surface with a non-circular design complimentary to said lengthwise section of the hinge pin.

3. The door stop as claimed in claim 2, wherein the braking or holding region has a single deviation from the purely circular shape.

4. The door stop as claimed in claim 2, wherein the hinge pin has two mutually opposite radially protruding circulatory deviations of said lengthwise section of the hinge pin.

5. The door stop as claimed in claim 2, wherein the hinge pin has two radially protruding circulatory deviations of said lengthwise section of the hinge pin, wherein highest points of said radially protruding deviations are arranged in angle respective to one another.

6. The door stop as claimed in claim 2, wherein the stop housing includes a slip coating on said internal peripheral surface of the stop housing.

7. The door stop as claimed in claim 2, wherein the internal peripheral surface of the stop housing is surface hardened.

8. The door stop as claimed in claim 1, further comprising a first rotational bearing and a second rotational bearing between the hinge pin and the stop housing, the first rotational bearing being located at a first side next to the braking or holding region and the second rotational bearing being located on another side next to the braking or holding region, said first and second rotational bearings having a cylindrical cross-sectional shape.

9. The door stop as claimed in claim 8, wherein the hinge pin has a plurality of diameter regions including a first diameter region, a second diameter region, a third diameter region and a fourth diameter region; the first rotational bearing being located over said first diameter region, the second diameter region forming the braking or holding region, the second rotational bearing being located over the third diameter region, and the fourth diameter region being fixed to the second leg, the first and third diameter regions having a different average diameter than the second diameter region.

10. The door stop as claimed in claim 9, wherein the stop housing has two cylindrical bearing recesses for accommodating the first and second rotational bearings, said bearing recesses being of the same diameter as each other.

11. The door stop as claimed in claim 10, wherein each of the first rotational bearing and the second rotational bearings includes a bushing, said bushing being designed as a collar type bushing and being made from a maintenance-free bearing material.

12. The door stop as claimed in claim 1, wherein the hinge pin has a peripheral knurling, said peripheral knurling securing said hinge pin from rotation in each of said first and second legs.

13. The door stop as claimed in claim 1, wherein said stop housing is formed from a profile material section, and wherein the first hinge half includes cap profile side areas, the stop housing being secured at both ends over a full external circumference in the cap profile side areas.

14. The door stop as claimed in claim 1, wherein the stop housing has a non-circular outer circumference having at least one longitudinal edge.

* * * * *